US005821040A

United States Patent [19]

Okutsu et al.

[11] Patent Number: 5,821,040

[45] **Date of Patent: *Oct. 13, 1998**

[54] METHOD FOR DEVELOPING SILVER HAIDE PHOTOGRAPHIC MATERIAL

[75] Inventors: Eiichi Okutsu; Shinnichi Morishima, both of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 667,603

[22] Filed: Jun. 21, 1996

[30] Foreign Application Priority Data

Jun. 21, 1995 [JP] Japan ..... 7-176909

[51] Int. Cl.[6] ..... G03C 7/407

[52] U.S. Cl. ..... 430/440; 430/446; 430/480; 430/483; 430/488

[58] Field of Search ..... 430/434, 440, 430/446, 488, 480, 483

[56] References Cited

U.S. PATENT DOCUMENTS

| | | | |
|---|---|---|---|
| 2,311,428 | 2/1943 | Wood | 430/434 |
| 4,120,728 | 10/1978 | Ikenoue et al. | 430/618 |
| 4,141,734 | 2/1979 | Lenoir et al. | 430/445 |
| 4,310,622 | 1/1982 | Onda et al. | 430/445 |
| 4,371,610 | 2/1983 | Toyoda et al. | 430/446 |
| 4,529,689 | 7/1985 | Lee | 430/534 |
| 4,814,260 | 3/1989 | Koboshi et al. | 430/464 |
| 4,985,348 | 1/1991 | Hirano et al. | 430/434 |
| 5,098,819 | 3/1992 | Knapp | 430/492 |
| 5,229,249 | 7/1993 | Katoh et al. | 430/434 |
| 5,236,816 | 8/1993 | Purol et al. | 430/436 |
| 5,264,323 | 11/1993 | Purol et al. | 430/264 |
| 5,356,761 | 10/1994 | Morimoto et al. | 430/448 |
| 5,364,746 | 11/1994 | Inoue et al. | 430/448 |
| 5,372,911 | 12/1994 | Obi et al. | 430/264 |
| 5,384,232 | 1/1995 | Bishop et al. | 430/440 |
| 5,385,811 | 1/1995 | Hirano | 430/438 |
| 5,457,009 | 10/1995 | Toyoda et al. | 430/399 |
| 5,474,879 | 12/1995 | Fitterman et al. | 430/487 |
| 5,503,965 | 4/1996 | Okutsu | 430/399 |
| 5,506,092 | 4/1996 | Ishikawa et al. | 430/399 |
| 5,510,231 | 4/1996 | Komatsu et al. | 430/399 |
| 5,591,567 | 1/1997 | Komatsu et al. | 430/399 |
| 5,648,205 | 7/1997 | Okutsu | 430/440 |

FOREIGN PATENT DOCUMENTS

| | | | |
|---|---|---|---|
| 0 627 658 | 12/1994 | European Pat. Off. . | |
| 952019685 | 9/1996 | European Pat. Off. . | |
| 752616A1 | 1/1997 | European Pat. Off. . | |
| 54-141126 | 2/1979 | Japan . | |
| 56-46585 | 11/1981 | Japan . | |
| 57-26848 | 2/1982 | Japan . | |
| 58-28737 | 2/1983 | Japan . | |
| 62-4702 | 1/1987 | Japan . | |
| 62-56959 | 3/1987 | Japan . | |
| 62-183455 | 8/1987 | Japan . | |
| 63-33744 | 2/1988 | Japan . | |
| 63-279249 | 11/1988 | Japan . | |
| 4333046 | 11/1992 | Japan | 430/488 |
| 4-362942 | 12/1992 | Japan . | |
| 5-66525 | 3/1993 | Japan . | |
| 5-88304 | 4/1993 | Japan . | |
| 284067 | 5/1995 | United Kingdom . | |
| WO9704355 | 2/1997 | WIPO . | |
| WO9704356 | 2/1997 | WIPO . | |

*Primary Examiner*—Hoa Van Le
*Attorney, Agent, or Firm*—Birch, Stewart, Kolasch & Birch, LLP

[57] ABSTRACT

Disclosed is a method for developing a silver halide photographic material, which comprises processing the silver halide photographic material having at least one silver halide emulsion layer containing silver halide grains, with a substantially hydroquinone-free developing solution containing (i) a compound represented by formula (A) as a developing agent, wherein at least 50% of the sum of the projected area of the silver halide grains are tabular silver halide grains having an aspect ratio of 3.0 or more, and said developing solution contains (ii) a compound represented by formula (B):

(A)

wherein $R_1$ represents a hydrogen atom, an alkyl group, an aryl group or a heterocyclic group; and (B)

wherein X represents an oxygen atom or a sulfur atom, Y represents a hydrogen atom or a substituent group, and M represents a hydrogen atom, an alkali metal ion, a quaternary ammonium ion or a quaternary phosphonium ion.

5 Claims, No Drawings

METHOD FOR DEVELOPING SILVER HAIDE PHOTOGRAPHIC MATERIAL

FIELD OF THE INVENTION

The present invention relates to a method for developing a silver halide photographic material, and more particularly to a method for developing a black-and-white silver halide photographic material with a developing solution containing a developing agent different from hydroquinone, and a developing agent composition therefor.

BACKGROUND OF THE INVENTION

Black-and-white silver halide photographic materials (for example, X-ray, printing, micro and negative photographic materials) have previously been developed with alkaline developing solutions each containing hydroquinone as a developing agent and a 3-pyrazolidone compound or an aminophenol compound as an auxiliary developing agent, followed by fixing and washing to form images. In particular, X-ray photographic materials contain silver halides in relatively large amounts and moreover are rapidly processed. Accordingly, high-active devolving solutions containing hydroquinone, the developing agent, in large amounts are used. In order to retain the high sensitivity of the developing solutions, such developing solutions have been replenished in large amounts against air oxidation. However, the use of hydroquinone has raised problems with regard to its own toxicity and safety. Methods using ascorbic acid or derivatives thereof as developing agents in place of hydroquinone are described in U.S. Pat. Nos. 2,688,549, 5,278,035, 5,236,816 and 5,098,819 and JP-A-3-249756 (the term "JP-A" as used herein means an "unexamined published Japanese patent application"). However, they are silent on methods for developing tabular silver halide grains using these developing solutions. Further, methods for improving silver tones of tabular silver halide grains are not described therein at all. Furthermore, methods for developing silver halide photographic materials at a small replenishment rate per unit area have never been known.

SUMMARY OF THE INVENTION

An object of the present invention is therefore to provide a method for developing a silver halide photographic material (particularly, an X-ray silver halide photographic material) with a hydroquinone-free developing solution containing ascorbic acid or an derivative thereof as a developing agent in place of hydroquinone to give improved silver tones, particularly without a reduction in photographic sensitivity. Further, developing waste solution has a high chemical oxygen demand (so-called C.O.D.) and a high biochemical oxygen demand (so-called B.O.D.). It is therefore important to decrease the replenishment rate per unit area of silver halide photographic material (particularly, X-ray photographic material) for reducing economical burden of waste solution processing.

According to the present invention, there is provided a method for developing a silver halide photographic material, which comprises processing the silver halide photographic material having at least one silver halide emulsion layer containing silver halide grains, with a substantially hydroquinone-free developing solution containing (i) a compound represented by formula (A) or a derivative thereof as a developing agent, wherein at least 50% of the sum of the projected area of the silver halide grains are tabular silver halide grains having an aspect ratio of 3.0 or more, and said developing solution contains (ii) a compound represented by formula (B):

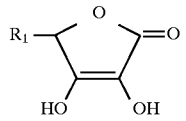

(A)

wherein $R_1$ represents a hydrogen atom, an alkyl group, an aryl group or a heterocyclic group; and

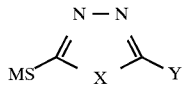

(B)

wherein X represents an oxygen atom or a sulfur atom, Y represents a hydrogen atom or a substituent group, and M represents a hydrogen atom, an alkali metal ion, a quaternary ammonium ion or a quaternary phosphonium ion.

DETAILED DESCRIPTION OF THE INVENTION

In the present specification, the substantially hydroquinone-free developing solution means that the developing solution contains hydroquinone(s) in an amount of 1 mmol/l or less, preferably 0 mmol/l.

Ascorbic acid and derivatives thereof represented by formula (A) are described in detail below.

In formula (A), the alkyl group represented by $R_1$ is a straight-chain, branched-chain or cyclic alkyl group having 1 to 10 carbon atoms, and the aryl group represented by $R_1$ is an aryl group having 6 t 10 carbon atoms such as phenyl or naphthyl. The heterocyclic group represented by $R_1$ is a 5- or 6-membered heterocyclic group composed of carbon, nitrogen, oxygen or sulfur atoms. Examples thereof include 1,3-dioxolanyl, 1,3-dioxolan-2-one, 1,3-dioxolan-4-one, 1,3,2-dioxothiolan-2-oxy, furyl, benzofuryl, pyranyl, pyrrolyl, imidazolyl, pyrazolyl, triazolyl, pyridyl, pyrimidyl, pyridazyl, thienyl and isothiazolyl.

These groups may have substituent groups, and examples thereof include alkyl, alkenyl, aryl, halogen, nitro, mercapto, hydroxyl, alkoxyl, aryloxy, alkylthio, arylthio, acyloxy, amino, alkylamino, carbonamido, sulfonamido, ureido, acyl, oxycarbonyl, carbamoyl, sulfinyloxy, carboxyl (including salts thereof), sulfo (including salts thereof), hydroxyamino and hydrazino.

Examples of the substituent groups are described in more detail. The alkyl groups are straight-chain, branched-chain or cyclic alkyl groups each having 1 to 16 carbon atoms, preferably 1 to 6 carbon atoms. These groups may be substituted by the groups given as the substituent groups for $R_1$, and examples thereof include methyl, ethyl, propyl, i-propyl, butyl, t-butyl, cyclohexyl and hydroxymethyl. The alkenyl groups are straight-chain or branched-chain alkenyl groups each having 2 to 16 carbon atoms, preferably 2 to 6 carbon atoms. These groups may be substituted by the groups given as the substituent groups for $R_1$, and examples thereof include ethenyl, propenyl, 3-butenyl and 4-hydroxy-3-butenyl. The aryl groups are aryl groups each having 6 to 10 carbon atoms. These groups may be substituted by the groups given as the substituent groups for $R_1$, and examples thereof include phenyl, naphthyl and p-methylphenyl. The alkoxyl groups are alkoxyl groups each having 1 to 19 carbon atoms, preferably 1 to 8 carbon atoms. These groups may be substituted by the groups given as the substituent groups for $R_1$, and examples thereof include methoxy, ethoxy, propoxy, butoxy, pentyloxy, hexyloxy, octyloxy and 2-methoxyethoxy. The aryloxy groups are aryloxy groups each having 6 to 10 carbon atoms. These groups may be substituted by the groups given as the substituent groups for $R_1$, and examples thereof include phenoxy, p-hydroxyphenoxy, 3,4-dihydroxyphenoxy, o-carboxyphenoxy and o-sulfophenoxy. The alkylthio groups are alkylthio groups each having 1 to 16 carbon atoms, preferably 1 to 8 carbon atoms. These groups may be substituted by the groups given as the substituent groups for $R_1$, and examples thereof include methylthio and octylthio. The arylthio groups are arylthio groups each having 6 to 10 carbon atoms. These groups may be substituted by the groups given as the substituent groups for $R_1$, and examples thereof include phenylthio, 4-hydroxyphenylthio, 4-methoxyphenylthio and 4-butoxyphenylthio. The acyloxy groups are acyloxy groups each having 1 to 17 carbon atoms, preferably 1 to 8 carbon atoms. These groups may be substituted by the groups given as the substituent groups for $R_1$, and examples thereof include acetoxy, propanoyloxy, butanoyloxy, octanoyloxy, carboxyacetoxy and 3-sulfopropanoyloxy. The alkylamino groups are alkylamino groups each having 1 to 6 carbon atoms, and examples thereof include methylamino, dimethylamino and diethylamino. The carbonamido groups are carbonamido groups each having 1 to 6 carbon atoms, and examples thereof include acetamido and propionamido. The sulfonamido groups are sulfonamido groups each having 1 to 6 carbon atoms, and examples thereof include methanesulfonamido. The ureido groups are ureido groups each having 1 to 6 carbon atoms, and examples thereof include ureido and methylureido. The acyl groups are acyl groups each having 1 to 6 carbon atoms, and examples thereof include acetyl and benzoyl. The oxycarbonyl groups are oxycarbonyl groups each having 1 to 8 carbon atoms, and examples thereof include methoxycarbonyl and ethoxycarbonyl. The carbamoyl groups are carbamoyl groups each having 1 to 6 carbon atoms, and examples thereof include carbamoyl and N,N-dimethylcarbamoyl. The sulfinyloxy groups are sulfinyloxy groups each having 1 to 6 carbon atoms, and examples thereof include methanesulfinyloxy.

These substituent groups may be further substituted if possible.

The alkyl groups represented by $R_1$ in the above-mentioned formula (A) are preferably alkyl groups each having 1 to 6 carbon atoms, including groups substituted by the groups given as the substituent groups for $R_1$, and more preferably are alkyl groups substituted by hydroxyl, alkoxyl, aryloxy, alkylthio, arylthio, acyloxy, amino, alkylamino, oxycarbonyl, carboxyl (including salts thereof) or sulfo (including salts thereof). Examples thereof include methyl, ethyl, hydroxymethyl, 1-hydroxyethyl, 1,2-dihydroxyethyl, 1,2-dihydroxypropyl, 1,2,3-trihydroxypropyl, 1,2,3,4-tetrahydroxybutyl, 1,2-dimethoxyethyl, 1,1-dimethoxy-2-hydroxyethyl, 1,2-diethoxyethyl, 1,2-diacetoxyethyl, hydroxycarboxymethyl, acetoxycarboxymethyl, 1-methylthio-2-hydroxyethyl, 1-phenylthio-2-hydroxymethyl, 1-hydroxy-2-octylthioethyl, 1-hydroxy-2-phenylthioethyl, 1-hydroxy-2-aminoethyl, 1-hydroxy-2-phenoxyethyl and 1-hydroxy-2-sulfoethyl. These substituent groups may be further substituted if possible.

The aryl groups represented by $R_1$ in the above-mentioned formula (A) are preferably phenyl groups, including groups substituted by the groups given as the substituent groups for $R_1$, and include, for example, phenyl, p-methylphenyl, anisyl, p-carboxyphenyl and p-sulfonylphenyl.

The heterocyclic groups represented by $R_1$ in the above-mentioned formula (A) are preferably 1,3-dioxolanyl, 1,3-dioxolan-2-one, 1,3-dioxolan-4-one, 1,3,2-dioxothiolan-2-oxy, furyl, pyridyl and triazolyl groups, and include groups substituted by the groups given as the substituent groups for $R_1$. Examples thereof are 2,2-dimethyl-1,3-dioxolane, cyclohexanespiro-2-dioxolane, 2,2-methylethyl-1,3-dioxolane, 2,2-methylisopropyl-1,3-dioxolane, 1,3-dioxolan-2-one, 2,2-dimethyl-1,3-dioxolan-4-one, 1,3,2-dioxothiolan-2-oxide, furyl, 5-methylfuryl, benzofuryl, pyridyl, 5-chloropyridyl, 3-carboxypyridyl, 5-sulfopyridyl and 1-phenyltriazolyl.

In the above-mentioned formula (A), $R_1$ is particularly preferably a hydrogen atom, a methyl group, an ethyl group or a 1,3-dioxolanyl group, including a group substituted by another group. Such substituent groups include alkyl, alkenyl, aryl, hydroxyl, alkoxyl and acyloxy groups. More preferably, the alkyl, alkenyl, alkoxyl and acyloxy groups are alkyl, alkenyl, alkoxyl and acyloxy groups each having 1 to 8 carbon atoms, and the aryl group is a phenyl group. These substituent groups may be further substituted if possible.

Of the compounds represented by the above-mentioned formula (A), a compound represented by the following formula (D) is most preferred:

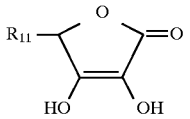

(D)

wherein $R_{11}$ represents a group represented by formula (E) or (F):

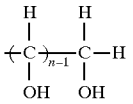

(E)

wherein n represents an integer of 1 to 4;

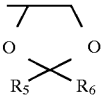

(F)

wherein $R_5$ and $R_6$, which may be the same or different, each represents a hydrogen atom, an alkyl group, an aryl group or an alkenyl group, and alkyl groups represented by $R_5$ and $R_6$ may combine with each other to form a ring structure. The alkyl, aryl and alkenyl groups include groups substituted by other substituent group(s), and such substituent groups include alkyl, alkenyl, aryl, halogen, nitro, hydroxyl, alkoxyl, acyl, carboxyl (including salts thereof), sulfo (including salts thereof) and hydroxyamino.

In the compound represented by formula (F), $R_5$ and $R_6$ are each preferably a hydrogen atom, an alkyl group having 1 to 7 carbon atoms, an aryl group having 6 to 10 carbon atoms or an alkenyl group having 2 to 7 carbon atoms, more preferably a hydrogen atom, an alkyl group having 1 to 7 carbon atoms or an aryl group having 6 to 10 carbon atoms, and most preferably a hydrogen atom or an alkyl group having 1 to 7 carbon atoms, and alkyl groups represented by $R_5$ and $R_6$ may combine with each other to form a ring structure. These groups include groups substituted by the groups given as the substituent groups for $R_5$ and $R_6$. Examples thereof include methyl, ethyl, propyl, butyl, phenyl, chloromethyl, methoxymethyl, 2-methoxyethyl, 1-hydroxyamino-1-methylethyl, 2-carboxyethyl, and cyclopentyl and cyclohexyl rings formed by the binding of the alkyl groups represented by $R_5$ and $R_6$. These substituent groups may be further substituted if possible.

The compounds represented by formula (A) are described in the so-called enol form. However, compounds in the keto form to which the compounds in the enol form are isomerized are the same compounds, and the compounds in which hydrogen atoms are isomerized are also within the scope of the following claims of the invention.

Specific examples of the compounds used in the present invention include but are not limited to the following compounds:

A-1

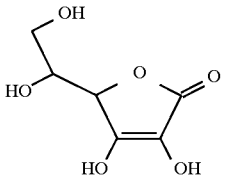

A-2

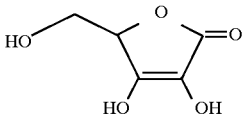

A-3

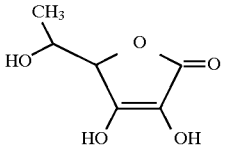

A-4

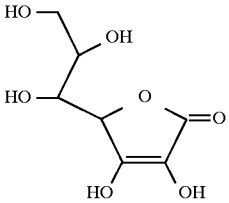

A-5

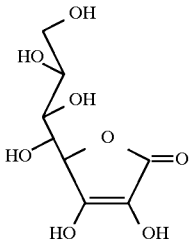

A-6

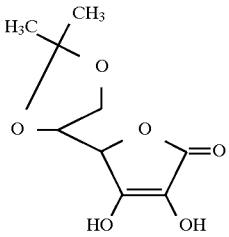

-continued

A-7

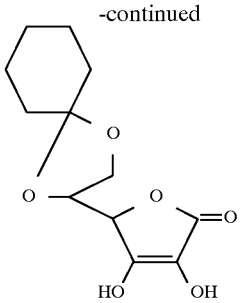

A-8

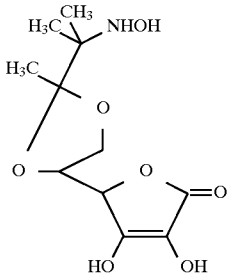

A-9

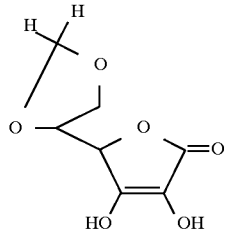

A-10

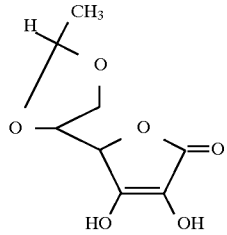

A-11

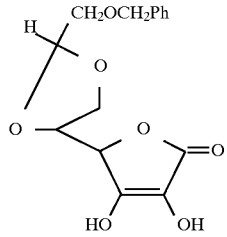

A-12

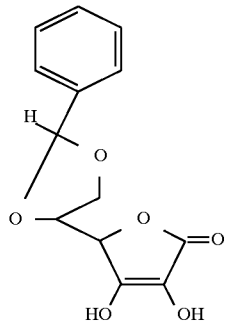

-continued
A-13
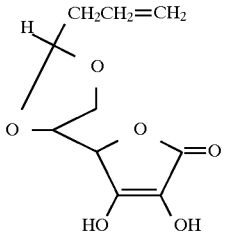
A-14
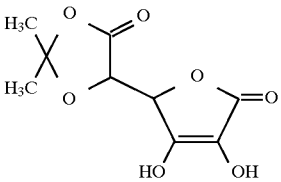
A-15
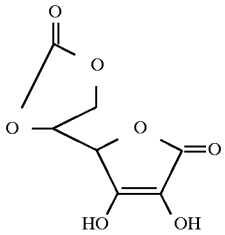
A-16
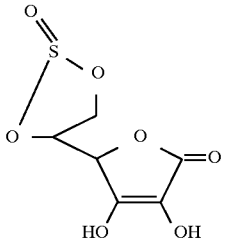
A-17
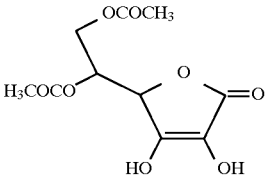
A-18
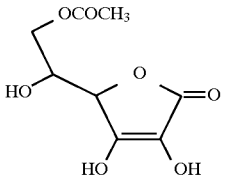
A-19
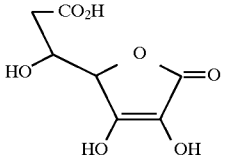
A-20
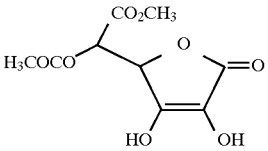
-continued
A-21
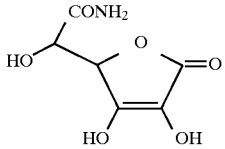
A-22
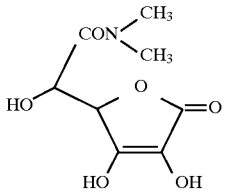
A-23
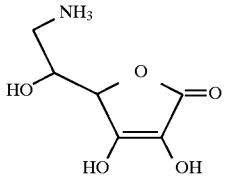
A-24
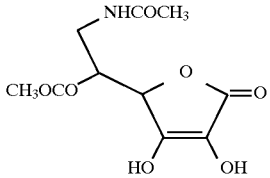
A-25
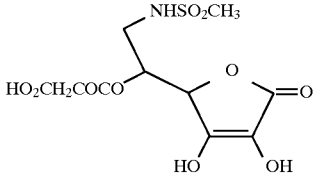
A-26
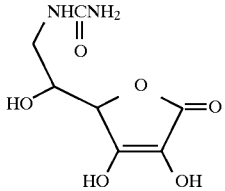
A-27
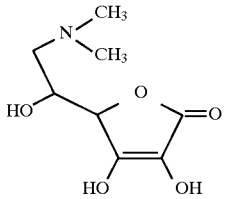
A-28
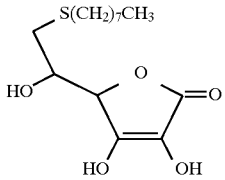

-continued
A-29
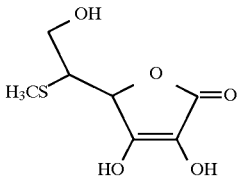
A-30
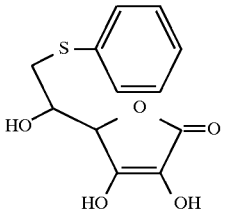
A-31
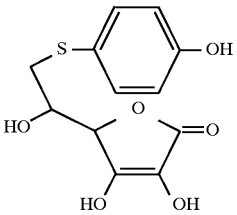
A-32
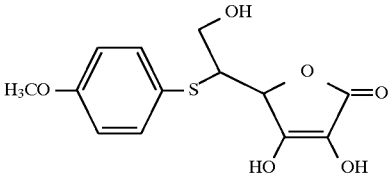
A-33
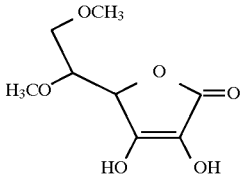
A-34
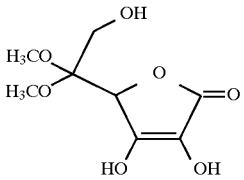
A-35
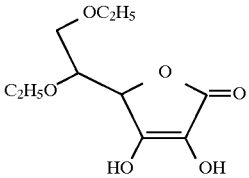
A-36
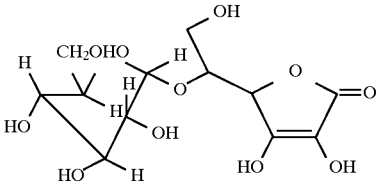
-continued
A-37
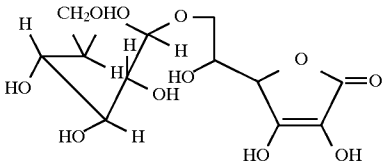
A-38
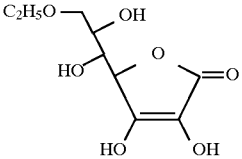
A-39
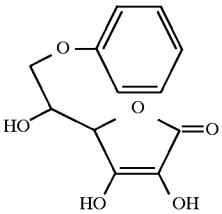
A-40
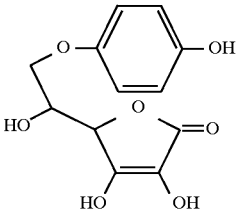
A-41
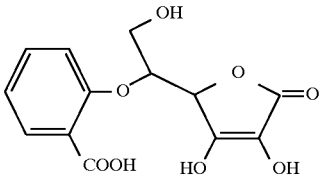
A-42
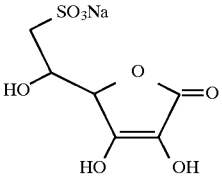
A-43
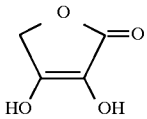
A-44
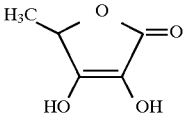
A-45
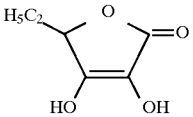

-continued

A-46

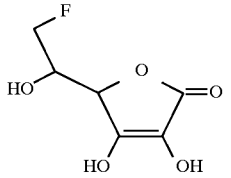

A-47

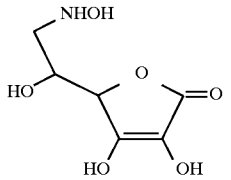

A-48

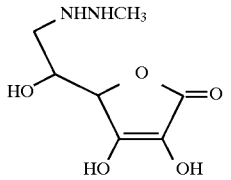

A-49

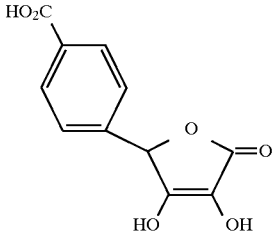

A-50

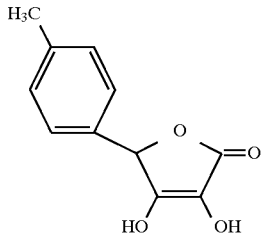

A-51

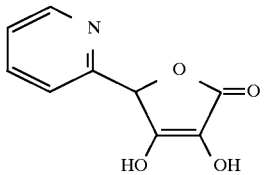

A-52

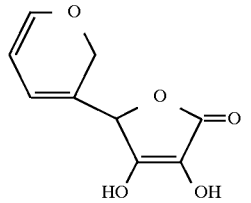

A-53

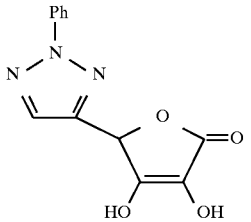

The compounds represented by formula (A) can be synthesized based on general synthesis methods described in E. S. H. EL. Ashry, A. Mousaad and N. Rashed, *Advance in Heterocyclic Chemistry,* 53, 233–302, JP-A-57-188586, JP-A-64-45383, JP-A-2-288872, JP-A-4-29985, JP-A-4-364182 and JP-A-5-112594.

Then, formula (B) is illustrated in detail below.

In formula (B), X represents an oxygen atom or a sulfur atom, and Y represents a hydrogen atom or a substituent group. Examples of the substituent groups represented by Y include straight-chain, branched-chain or cyclic alkyl having 1 to 10 carbon atoms, aryl having 6 to 10 carbon atoms, mercapto, straight-chain or branched chain alkylthio having 1 to 10 carbon atoms, arylthio having 6 to 10 carbon atoms, acyloxy having 1 to 10 carbon atoms, amino, alkylamino having 1 to 10 carbon atoms, carbonamido having 2 to 10 carbon atoms, sulfonamido having 1 to 10 carbon atoms, oxycarbonylamino having 2 to 10 carbon atoms, ureido having 1 to 10 carbon atoms, acyl having 2 to 10 carbon atoms, oxycarbonyl having 2 to 10 carbon atoms, carbamoyl having 1 to 10 carbon atoms, sulfonyl having 1 to 10 carbon atoms, sulfinyl having 1 to 10 carbon atoms, sulfamoyl, carboxyl (including salts thereof) and sulfo (including salts thereof). These groups may have substituent groups, which include alkyl, aryl, heterocyclic, hydroxyl, alkoxyl, alkylthio, amino, alkylamino, carbonamido, sulfonamido, sulfonyl, carboxyl (including salts thereof) and sulfo (including salts thereof).

The substituent groups for Y are shown in more detail. The alkyl groups are straight-chain, branched-chain or cyclic alkyl groups each having 1 to 10 carbon atoms, preferably 1 to 5 carbon atoms. These groups may have substituent groups, and the groups given as the substituent groups for Y can be applied as such substituent groups. Examples thereof include methyl, ethyl, propyl, i-propyl, butyl, t-butyl and hydroxymethyl. The aryl groups are aryl groups each having 6 to 10 carbon atoms. These groups may have substituent groups, and the groups given as the substituent groups for Y can be applied as such substituent groups. Preferred examples thereof include phenyl, o-carboxyphenyl and p-sulfophenyl. The heterocyclic groups are 5- or 6-membered heterocyclic groups composed of carbon, nitrogen, oxygen or sulfur atoms, and examples thereof include furyl, benzofuryl, pyrrolyl, imidazolyl, pyrazolyl, pyridyl, thienyl, isothiazolyl, pyrrolidinyl, piperazinyl and morpholinyl. These groups may have substituent groups, and the groups given as the substituent groups for Y can be applied as such substituent groups. Preferred examples thereof include imidazolyl, pyrrolidinyl, piperazinyl and morpholinyl. The alkoxyl groups are alkoxyl groups each having 1 to 10 carbon atoms, preferably 1 to 5 carbon atoms. These groups may have substituent groups, and the groups given as the substituent groups for Y can be applied as such substituent groups. Examples thereof include methoxy, ethoxy, propoxy, butoxy, pentyloxy and 2-hydroxyethoxy. The alkylthio groups are alkylthio groups each having 1 to 10 carbon atoms, preferably 1 to 5 carbon atoms. These groups may have substituent groups, and the groups given as the substituent groups for Y can be applied as such substituent groups. Examples thereof include methylthio, carboxymethylthio, 2-dimethylaminoethylthio and 2-sulfoethylthio. The alkylamino groups are alkylamino groups each having 1 to 10 carbon atoms, preferably 1 to 6 carbon atoms. These groups may have substituent groups, and the groups given as the substituent groups for Y can be applied as such substituent groups. Examples thereof include monomethylamino, dimethylamino, diethylamino, diisopropylamino, dibutylamino, dicarboxymethylamino and dicarboxyethylamino. The carbonamido groups are carbonamido groups each having 1 to 6 carbon atoms. These groups may have substituent groups, and the groups given as the substituent groups for Y can be applied as such substituent groups. Examples thereof include acetamido and propionamido. The sulfonyl groups are sulfonyl groups each having 1 to 5 carbon atoms, and examples thereof include methanesulfonyl.

These substituent groups may be further substituted if possible.

The alkyl groups represented by Y in the above-mentioned formula (B) are preferably alkyl groups each having 1 to 5 carbon atoms, including groups substituted by the groups given as the substituent groups for Y, and more preferably are alkyl groups substituted by hydroxyl, amino, alkylamino, carboxyl (including salts thereof) or sulfo (including salts thereof). Examples thereof include methyl, ethyl, butyl, i-propyl, hydroxymethyl, carboxymethyl, sulfomethyl, hydroxyethyl, carboxyethyl, 1,2-dicarboxyethyl, sulfoethyl, carboxypropyl, sulfopropyl, carboxybutyl, aminomethyl, dimethylaminomethyl, diethylaminomethyl, dimethylaminoethyl and diethylaminoethyl.

The aryl groups represented by Y in the above-mentioned formula (B) are preferably phenyl groups, including groups substituted by the groups given as the substituent groups for Y, and include, for example, phenyl, p-methylphenyl, anisyl, p-carboxyphenyl, p-sulfonylphenyl and p-acetamidophenyl. These substituent groups may be further substituted if possible.

The alkylthio groups represented by Y in the above-mentioned formula (B) are preferably alkylthio groups each having 1 to 6 carbon atoms, including groups substituted by the groups given as the substituent groups for Y, and more preferably are alkyl groups substituted by heterocyclic, hydroxyl, alkoxyl, alkylthio, amino, alkylamino, sulfonyl, carboxyl (including salts thereof) or sulfo (including salts thereof). Examples thereof include methylthio, ethylthio, benzylthio,hydroxyethylthio, carboxymethylthio, sulfomethylthio, carboxyethylthio, 1,2-dicarboxyethylthio, sulfoethylthio, 1-carboxypropylthio, sulfopropylthio, sulfobutylthio, ethoxyethylthio, aminomethylthio, dimethylaminomethylthio, diethylaminomethylthio, aminoethylthio, monomethylaminoethylthio, dimethylaminoethylthio, diethylaminoethylthio, diisopropylaminoethylthio, dimethylaminopropylthio, dimethylaminobutylthio, dimethylaminohexylthio, 2-imidazolylethylthio, 2-pyrrolidinylethylthio, 2-piperazinylethylthio, 2-morpholinylethylthio and methanesulfonylethylthio. These substituent groups may be further substituted if possible.

The arylthio groups represented by Y in the above-mentioned formula (B) are preferably phenylthio groups, including groups substituted by the groups given as the substituent groups for Y, and include, for example, phenylthio, p-carboxyphenylthio and p-sulfonylphenylthio. The acyloxy groups are preferably acyloxy groups having 1 to 5 carbon atoms, and examples thereof include actoxy. The alkylamino groups are preferably alkylamino groups each having 1 to 5 carbon atoms, and include, for example, methylamino, dimethylamino and diethylamino. The carbonamido groups are preferably carbonamido groups each having 2 to 7 carbon atoms, and include, for example, acetamido and benzamido. The sulfonamido groups are sulfonamido groups each having 1 to 6 carbon atoms, and examples thereof include methanesulfonamido and benzenesulfonamido. The oxycarbonylamino groups are preferably oxycarbonylamino groups each having 1 to 7 carbon atoms, and include, for example, methoxycarbonylamino and phenoxycarbonylamino. The ureido groups are preferably ureido groups each having 1 to 7 carbon atoms, and examples thereof include methylureido and phenylureido. The acyl groups are preferably acyl groups each having 1 to 6 carbon atoms, and examples thereof include acetyl and benzoyl. The oxycarbonyl groups are preferably oxycarbonyl groups each having 1 to 7 carbon atoms, and examples thereof include methoxycarbonyl and phenoxycarbonyl. The carbamoyl groups are preferably carbamoyl groups each having 1 to 6 carbon atoms, and examples thereof include carbamoyl. The sulfonyl groups are preferably sulfonyl groups each having 1 to 6 carbon atoms, and include, for example, methanesulfonyl. The sulfinyl groups are sulfinyl groups each having 1 to 6 carbon atoms, and examples thereof include methanesulfinyl. The sulfamoyl groups are preferably sulfamoyl groups each having 1 to 6 carbon atoms, and include, for example, sulfamoyl and diethylsulfamoyl. These substituent groups may be further substituted if possible.

In formula (B), examples of the alkali metals represented by M include lithium, sodium and potassium, and the quaternary ammonium salts include, for example, ammonium and trimethylammonium.

Of the compounds represented by the above-mentioned formula (B), a compound represented by the following formula (C) is more preferred:

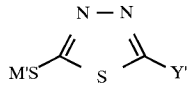

(C)

wherein Y' has the same meaning as given for Y in formula (B), and M' has the same meaning as given for M in formula (B).

In formula (C), Y' is particularly preferably alkyl, mercapto, alkylthio, amino or alkylamino, and most preferably alkylthio.

These groups include groups substituted by other substituent groups, which include heterocyclic, hydroxyl, alkoxyl, alkylthio, amino, alkylamino, carboxyl (including salts thereof) and sulfo (including salts thereof). These substituent groups may be further substituted if possible, and the groups given as the substituent groups for Y can be applied as such substituent groups.

Specific examples of the compounds used in the present invention include but are not limited to the following compounds:

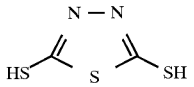

B-1

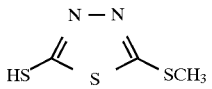

B-2

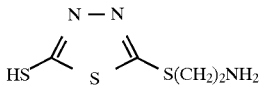

B-3

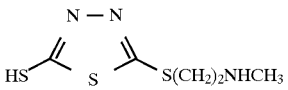

B-4

-continued
B-5
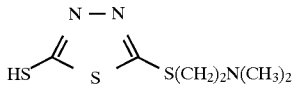
B-6
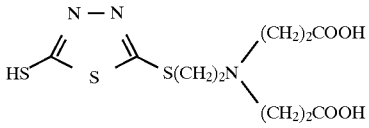
B-7
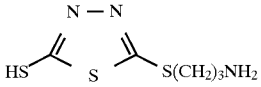
B-8
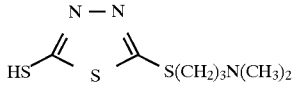
B-9
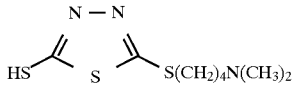
B-10
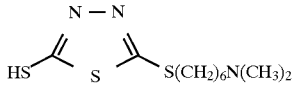
B-11
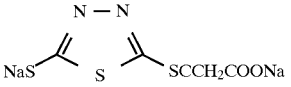
B-12
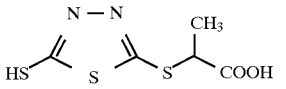
B-13
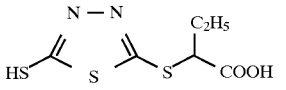
B-14
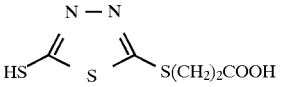
B-15
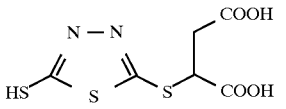
B-16
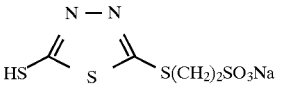
B-17
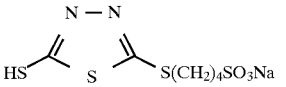
B-18
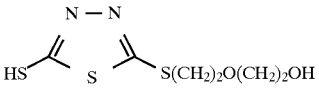
B-19
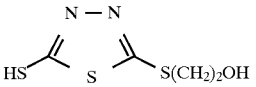
B-20
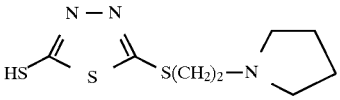
B-21
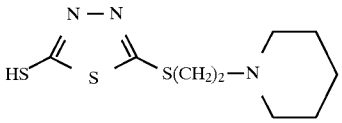
B-22
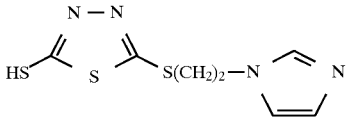
B-23
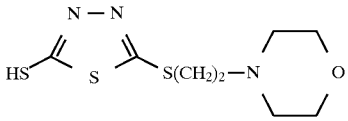
B-24
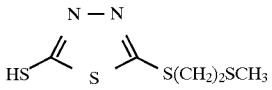
B-25
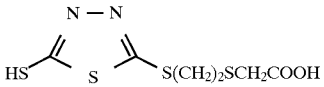
B-26
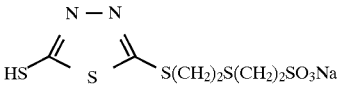
B-27
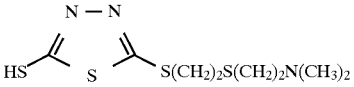
B-28
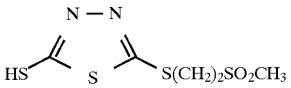
B-29
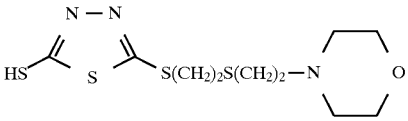
B-30
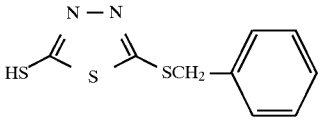
B-31
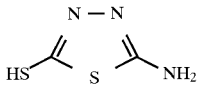
B-32
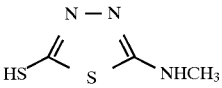
B-33
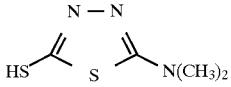
B-34
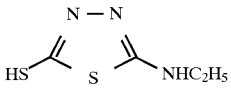
B-35
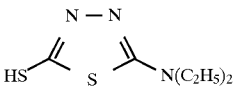

-continued
B-36
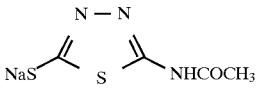
B-37
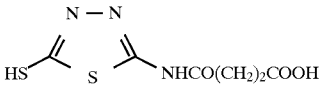
B-38
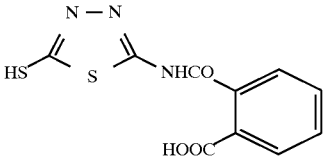
B-39
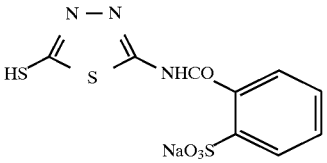
B-40
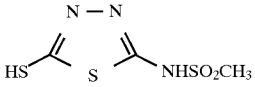
B-41
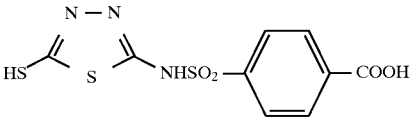
B-42
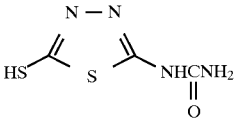
B-43
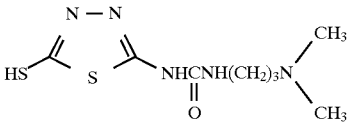
B-44
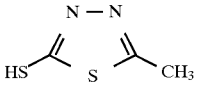
B-45
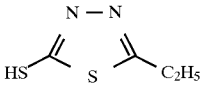
B-46
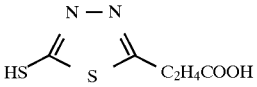
B-47
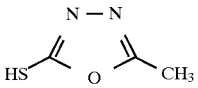
B-48
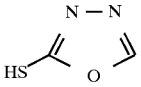
B-49
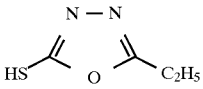
-continued
B-50
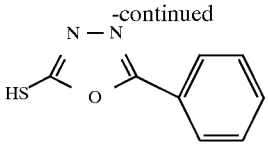
B-51
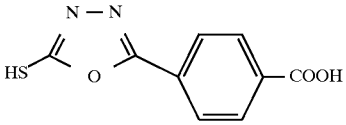
B-52
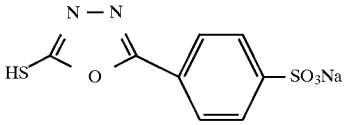
B-53
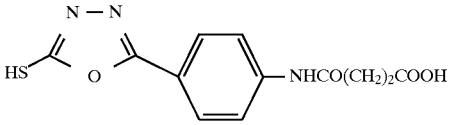
B-54
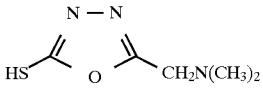
B-55
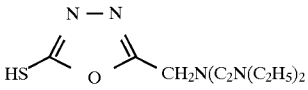
B-56
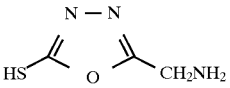
B-57
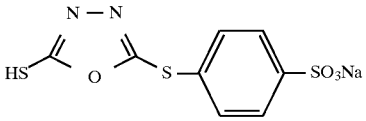
B-58
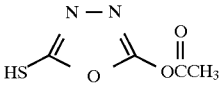
B-59
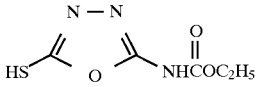
B-60
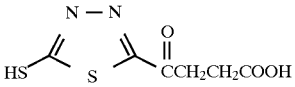
B-61
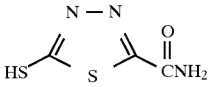
B-62
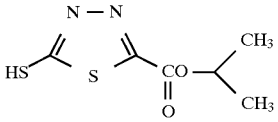
B-63
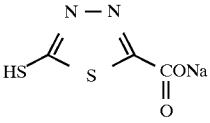

-continued

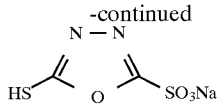

B-64

The compounds represented by formula (B) can be synthesized based on general synthesis methods described in *Advance in Heterocyclic Chemistry,* 9, 165–209, *J. Am. Chem. Soc.,* 44, 1502–1510, JP-A-55-59463, JP-B-49-8334 (the term "JP-B" as used herein means an "examined Japanese patent publication"), U.S. Pat. No. 3,017,270, British Patent 940,169 and West German Patent 2,716,707.

The ascorbic acid compounds represented by formula (A) used in the present invention can also be used in the form of alkali metal salts such as lithium salts, sodium salts and potassium salts. These ascorbic acid compounds are used preferably in an amount of 1 g to 100 g per liter of developing solution, and more preferably in an amount of 5 g to 80 g per liter of developing solution.

Auxiliary developing agents showing superadditivity include 3-pyrazolidone developing agents such as 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

These auxiliary developing agents are used preferably in an amount of $10^{-4}$ mol to $10^{-1}$ mol/liter, and more preferably in an amount of $5\times10^{-4}$ mol to $5\times10^{-2}$ mol/liter.

p-Aminophenol auxiliary developing agents include N-methyl-p-aminophenol, p-aminophenol, N-(-hydroxyethyl)-p-aminophenol, N-(4-hydroxyphenyl) glycine, 2-methyl-p-aminophenol and p-benzylaminophenol. Of these, N-methyl-p-aminophenol is preferred. These auxiliary developing agents are used preferably in an amount of $10^{-4}$ mol to $10^{-1}$ mol/liter, and more preferably in an amount of $5\times10^{-4}$ mol to $5\times10^{-2}$ mol/liter.

The pH of the developing solutions is preferably 8.5 to 11.0, and more preferably 9.3 to 11.0. Sodium hydroxide and potassium hydroxide are used as alkaline agents, and sodium primary phosphate, sodium secondary phosphate, potassium primary phosphate and potassium secondary phosphate can be used as pH buffers. As carbonates, there can be used sodium hydrogencarbonate, sodium carbonate, potassium hydrogencarbonate and potassium carbonate. These pH buffers are used in developing solutions (working solutions) in an amount of 0.2 mol/liter or more, and more preferably in an amount of 0.30 mol/liter or more. In particular, the pH buffers are preferably the carbonates among others. It is particularly preferred to use the carbonates in an amount of 0.5 mol/liter or more.

In the present invention, the concentration of the compounds represented by formulas (B) and (C) contained in developing solutions (working solutions) is preferably 0.01 mmol to 50 mmol/liter , more preferably 0.05 mmol to 10 mmol/liter, and most preferably 0.1 mmol to 5 mmol/liter.

The following additive may be added to the developing solution. Development inhibitors such as sodium bromide and potassium bromide, and organic solvents such as dimethylformamide, methyl cellosolve, hexylene glycol, ethanol and methanol may be added. Benztriazole derivatives include 5-methylbenztriazole, 5-bromobenztriazole, 5-chlorobenztriazole, 5-butylbenztriazole and benztriazole. In particular, benztriazole is preferably used. Further, compounds described in JP-B-56-46585, JP-B-62-4702, JP-B-62-4703, U.S. Pat. Nos. 4,254,215 and 3,318,701, JP-A-58-203436, JP-A-62-56959, JP-A-62-178247, JP-A-1-200249, JP-A-4-362942, JP-A-5-303179 and JP-A-5-53257 can also be used in the developing solutions of the present invention as silver stain inhibitors. The amount of these silver stain inhibitors used is preferably 0.01 mmol to 50 mmol per liter of developing solution, more preferably 0.05 mmol to 10 mmol per liter, and most preferably 0.1 mmol to 5 mmol per liter.

Preservatives of sulfites which can be used in the developing solutions of the present invention include sodium sulfite, potassium sulfite, lithium sulfite, ammonium sulfite, sodium bisulfite and potassium metabisulfite. The sulfites are preferably used in an amount of 0.01 mol/liter or more, and particularly in an amount of 0.02 mol/liter or more. The upper limit thereof is preferably 1.0 mol/liter.

Further, compounds described in L. F. A. Mayson, *Photographic Processing Chemistry*, pages 226 to 229 (Focal Press, 1966), U.S. Pat. Nos. 2,193,015 and 2,592,364 and JP-A-48-64933, etc. may also be used.

In addition, the developing solutions used in the present invention may contain surfactants, water softeners and hardening agents if necessary.

Chelating agents contained in the developing solutions include ethylenediaminediorthohydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, 1,3-diaminopropanoltetraacetic acid, triethylenetetraminehexaacetic acid, trans-cyclohexanediaminetetraacetic acid, ethylenediaminetetraacetic acid, glycoletherdiaminetetraacetic acid, ethylenediaminetetrakismethylenephosphonic acid, diethylenetriaminepentamethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,3,3-tricarboxylic acid, catechol-3,4-disulfonic acid, sodium pyrophosphate, sodium tetrapolyphosphate and sodium hexametaphosphate. Particularly preferred examples thereof include diethylenetriaminepentaacetic acid, triethylenetetraminehexaacetic acid, 1, 3-diaminopropanoltetraacetic acid, glycoletherdiaminetetraacetic acid, hydroxyethylethylenediaminetriacetic acid, 2-phosphonobutane-1,2,4-tricarboxylic acid, 1,1-diphosphonoethane-2-carboxylic acid, nitrilotrimethylenephosphonic acid, ethylenediaminetetraphosphonic acid, diethylenetriaminepentaphosphonic acid, 1-hydroxypropylidene-1,1-diphosphonic acid, 1-aminoethylidene-1,1-diphosphonic acid, 1-hydroxyethylidene-1,1-diphosphonic acid and salts thereof. These chelating agents are used preferably in an amount of at least 0.5 g per liter of working solution, and more preferably in an amount of at least 1.0 g per liter.

The developing solutions may be stored in containers formed of packaging materials having an oxygen permeability of 50 ml/$m^2$.atm.day (at a temperature of 20° C. at a relative humidity of 65%) or less and a thickness of 1 mm or more. However, it is preferred that the developing solutions are stored in containers formed of plastic packaging materials comprising at least one of saponified ethylene-vinyl acetate copolymers and nylon and having a thickness of 0.5 mm or less and an oxygen permeability of 50 ml/$m^2$.atm.day (at a temperature of 20° C. at a relative humidity of 65%) or less, said materials being flexible and easily handled.

More preferably, the developing solutions are stored in containers formed of packaging materials having an oxygen permeability of 25 ml/$m^2$.atm.day (at a temperature of 20° C. at a relative humidity of 65%) or less, whereby stable photographic characteristics can be obtained even after long-term storage of the developing solutions.

The oxygen permeability is measured by a method described in N. J. Calvano et al., "$O_2$ Permeation of Plastic Container", *Modern Packing*, pages 143 to 145 (December, 1968).

The solutions of processing agents used in the present invention can be prepared by methods described in JP-A-61-177132, JP-A-3-134666 and JP-A-3-67258. In the present invention, the developing solutions can be replenished by methods described in JP-A-5-216180. The replenishment rate is preferably 200 ml or less per $m^2$ of photographic material, and more preferably 30 ml to 150 ml per $m^2$.

Fixing solutions used in the present invention are aqueous solutions containing thiosulfates, and have a pH of 3.8 or more, and preferably a pH of 4.2 to 6.2.

Fixing agents include sodium thiosulfate and ammonium thiosulfate. The amount of the fixing agents used can be appropriately varied. The fixing solutions may contain water-soluble aluminum salts acting as hardening agents, which include, for example, aluminum chloride, aluminum sulfate and potassium alum.

The fixing solutions may contain tartaric acid, citric acid, gluconic acid or derivatives thereof alone or in combination. The effective amount of these compounds is 1 0.005 mol per liter of fixing solution, and 0.01 mol/liter to 0.03 mol/liter is particularly effective.

The fixing solutions can contain preservatives preferably in an amount of 10 g or more per liter of working solution, and more preferably in an amount of 50 g per liter (for example, sulfites and bisulfites), if necessary. The fixing solutions can also contain pH buffers (for example, acetic acid and boric acid). The pH buffers are used preferably in an amount of 0.2 mol or more per liter of working solution, and more preferably in an amount of 0.5 mol or more per liter. The fixing solutions can also contain pH regulators (for example, sulfuric acid), chelating agents having water softening ability and compounds described in JP-A-62-78551.

In the processing methods of the present invention, methods described in JP-A-1-4739 and JP-A-3-101728 can be used to enhance fixing.

In the above-mentioned processing methods of the present invention, the photographic materials are subjected to development and fixing steps, and then processed with washing water and stabilizing solutions, followed by drying.

In the present invention, various types of automatic processors such as roller transfer type and belt transfer type automatic processors can be used. However, the roller transfer type automatic processors are preferably used. Further, by use of automatic processors having development tanks low in opening ratio as described in JP-A-1-166040 and JP-A-1-193853, the photographic materials are squeegeed to remove washing water off, namely allowed to pass through squeegee rolls to dry them, reducing air oxidation and evaporation.

It is sometimes more preferred that washing water used in the present invention is passed through a filter member or an activated carbon filter to remove dirt or organic substances existing in water as pretreatment before supply to a washing tank.

Methods which can be used in combination therewith include an ultraviolet irradiation method described in JP-A-60-263939, a method using a magnetic field described in JP-A-60-263940, a method using an ion-exchange resin to obtain pure water described in JP-A-61-131632, a method described in JP-A-4-151143 and JP-A-4-151143 in which water is circulated through a filter and an adsorbent column while blowing ozone therein, a method using microbial decomposition described in JP-A-4-240636 and methods using microbiocides described in JP-A-62-115154, JP-A-62-153952, 62-220951 and JP-A-62-209532, which are known as antifungal means.

Further, microbiocides, antifungal agents, surfactants, etc. described in M. W. Reach, "Microbiological Growths in Motion-Picture Processing", *SMPTE Journal,* 85 (1976), R. O. Deegan, "Photo Processing Wash Water Biocides", *J. Imaging Tech.,* 10, No. 6 (1984), JP-A-57-8542, JP-A-57-58143, JP-A-58-105145, JP-A-57-132146, JP-A-58-18631, JP-A-57-97530 and JP-A-57-257244 can also be used in combination as required.

Furthermore, isothiazoline compounds and bromochloromethylhydantoin described in R. T. Kreiman, *J. Image. Tech.,* 10, No. 6, 242 (1984), isothiazoline compounds described in *Research Disclosure,* 205, No. 20526 (May, 1981) and ibid., 228, No. 22845 (April, 1983) and compounds described in JP-A-62-209532 can also be used in combination as microbiocides in washing baths (or stabilizing baths).

In addition, compounds as described in Hiroshi Horiguchi, *Bohkin Bohbai no Kagaku* (*Chemistry of Bacteria Prevention and Fungus Prevention*), Sankyo Shuppan (1982) and *Bohkin Bohbai Gijutsu Handbook* (*Handbook of Bacteria Prevention and Fungus Prevention*), edited by Nippon Bohkin Bohbai Gakkai, Hakuhohdoh (1986) may be contained.

The photographic materials which have been developed, fixed and washed (or stabilized) are squeegeed to remove washing water off, namely allowed to pass through squeegee rolls to dry them. Drying is conducted at about 40° C. to about 100° C. The drying time is usually about 5 seconds to about 3 minutes, and preferably about 5 seconds to 2 minutes at 40° to 80° C., although appropriately changed depending upon the environmental conditions.

When development processing is conducted for 100 seconds or less at dry to dry, it is preferred to apply a roll of rubber material to an outlet roll of a development tank as described in JP-A-63-151943, to agitate a developing solution in a developing solution tank at an extrusion flow rate of 10 m/minute or more as described in 63-151944, or to agitate more vigorously at least during development processing than during the stand-by condition as described in JP-A-63-264758, in order to prevent uneven development characteristic of rapid processing.

The silver halide photographic materials comprising silver halide grains having an aspect ratio of 3.0 or more used in the present invention are described below.

The diameter of a sphere equal in volume to the emulsion grain is preferably 0.2 $\mu$m to less than 2.0 $\mu$m, and more preferably 0.5 $\mu$m to less than 1.5 $\mu$m. Tabular grains having an aspect ratio of 3.0 or more are preferably used in the present invention. The upper limit of the aspect ratio is preferably about less than 15. Details thereof are described in *Research Disclosure,* 225, Item 22534, 20–58 (January, 1983), JP-A-58-127921 and JP-A-58-113926. The tabular silver halide grains can be produced by an appropriate combination of methods known in the art. The tabular silver halide emulsions can be easily prepared by reference to JP-A-58-127921,- JP-A-58-113927, JP-A-58-113928 and U.S. Pat. No. 4,439,520.

In order to effectively utilize the effect of the present invention, selenium compounds described in known patents can be used as selenium sensitizers. In the present invention, compounds described in JP-B-46-4553, JP-B-52-34492 and JP-B-52-34491 are used as non-unstable type selenium compounds. Examples of the non-unstable type selenium compounds include selenious acid, potassium selenocyanate, selenazoles, quaternary salts of selenazoles, diaryl selenides, diaryl diselenides, dialkyl selenides, dialkyl diselenides, 2-selenazolidineone, 2-selenoxazolidinethione and derivatives thereof.

Solvents for silver halides which can be used in the present invention include (a) organic thioethers described in U.S. Pat. Nos. 3,271,157, 3,531,289 and 3,574,628, JP-A-54-1019 and JP-A-54-158917, (b) thiourea derivatives described in JP-A-53-82408, JP-A-55-77737 and JP-A-55-2982, (c) solvents for silver halides having thiocarbonyl groups put between oxygen or sulfur atoms and nitrogen atoms described in JP-A-53-144319, (d) imidazole derivatives described in JP-A-54-100717, (e) sulfites and (f) thiocyanates. Particularly preferred examples of the solvents include thiocyanates and tetramethylthiourea. The amount of the solvents used is preferably $1\times10^{-4}$ mol to $1\times10^{-2}$ mol per mol of silver halide, for example, for the thiocyanates, although it varies depending upon the kind thereof. For the silver halide photographic emulsions used in the present invention, higher sensitivity and lower fog can be achieved by use in combination with sulfur sensitization and/or gold sensitization in chemical sensitization. The sulfur sensitization is usually conducted by adding a sulfur sensitizer and stirring an emulsion at a high temperature, preferably at 40° C. or higher, for a definite period of time. Further, gold sensitization is usually conducted by adding a gold sensitizer and stirring an emulsion at a high temperature, preferably at 40° C. or higher, for a definite period of time. Known sulfur sensitizers can be used for the above-mentioned sulfur sensitization. Examples thereof include thiosulfates, thiourea compounds, allyl isothiocyanate, cystine, p-toluenethiosulfonates and rhodanine. Besides, sulfur sensitizers described in U.S. Pat. Nos. 1,574,944, 2,410,689, 2,278,947, 2,728,668, 3,501,313 and 3,656,955, German Patent 1,422,869, JP-B-56-24937, JP-A-55-45016, etc. can also be used. The sulfur sensitizers may be added in an amount enough to effectively increase the sensitivity of the emulsions. This amount varies over a considerable range depending on various conditions such as the pH, the temperature and the size of silver halide grains. However, it is preferably $1\times10^{-7}$ mol to $5\times10^{-4}$ mol per mol of silver halide.

The oxidation number of gold used as the gold sensitizers in the above-mentioned gold sensitization may be either +1 or +3, and gold compounds usually employed as the gold sensitizers can be used. Typical examples thereof include chloroaurates such as potassium chloroaurate, auric trichloride, potassium auric thiocyanate, potassium iodoaurate, tetracyanoauric acid, ammonium aurothiocyanate and pyridyltrichlorogold. Although the amount of the gold sensitizers added varies depending upon various conditions, it is preferably $1\times10^{-7}$ mol to $5\times10^{-4}$ mol per mol of silver halide, as a measure.

In order to effectively utilize the effect of the present invention, it is preferred that a silver halide-absorbent material is allowed to exist in an amount of at least 0.5 mmol per mol of silver halide in chemical sensitization during the emulsion preparation step as described in JP-A-2-68539. The silver halide-absorbent material may be added at any time during grain formation, just after grain formation, before or after initiation of after-ripening. However, the silver halide-absorbent material is preferably added before addition of the chemical sensitizer such as the gold or sulfur sensitizer, or at the same time that the chemical sensitizer is added. The silver halide-absorbent material is required to exist at least in the course of progress of chemical sensitization. The silver halide-absorbent material may be added at any temperature within the range of 30° C. to 80° C. In order to enhance absorbability, however, it is preferably added at a temperature ranging from 50° C. to 80° C. The pH and the pAg may also be arbitrarily chosen, but it is preferred that the pH is 5 to 10 and the pAg is 7 to 9 at the time when chemical sensitization is conducted.

The term "silver halide-absorbent material" as used herein means a sensitizing dye or a photographic characteristic stabilizer. Namely, the silver halide-absorbent materials include many compounds known as antifoggants or stabilizers such as azoles (for example, benzothiazolium salts, benzoimidazolium compounds, imidazole compounds, benzimidazole compounds, nitroindazole compounds, triazole compounds, benzotriazole compounds, tetrazole compounds and triazine compounds); mercapto compounds (for example, mercaptothiazole compounds, mercaptobenzothiazole compounds, mercaptoimidazole compounds, mercaptobenzimidazole compounds, mercaptobenzoxazole, mercaptothiadiazole compounds, mercaptooxadiazole compounds, mercaptotetrazole compounds, mercaptopyrimidine compounds and mercaptotriazine compounds); thioketo compounds (for example, oxazolinethione); azaindene compounds (for example, triazaindene compounds, tetraazaindene compounds (particularly, 4-hydroxy-substituted (1,3,3a,7)tetraazaindene compounds) and pentaazaindene compounds). Further, purine compounds, nucleic acids or polymers described in JP-B-61-36213, JP-A-59-90844, etc. are also available for the absorbent materials.

The sensitizing dyes can realize the favorable effect as the silver halide-absorbent materials. The sensitizing dyes which can be used include cyanine dyes, merocyanine dyes, complex cyanine dyes, complex merocyanine dyes, holopolarcyanine dyes, styryl dyes, hemicyanine dyes, oxonol dyes and hemioxonol dyes. The useful sensitizing dyes used in the present invention are described, for example, in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, JP-A-48-76525 and Belgian Patent 691,807.

Photographic emulsion layers or other hydrophilic colloidal layers of the photographic materials produced according to the present invention may contain various surfactants for the various purposes of coating aids, static charge prevention, improvement in slipperiness, emulsified dispersion, adhesion prevention, improvement in photographic characteristics (for example, development acceleration, hardening and sensitization), etc.

Gelatin is advantageously used as a binder or a protective colloid for emulsion layers, intermediate layers and surface protective layers of the photographic materials produced according to the present invention, but other hydrophilic colloids can also be used. Examples thereof include proteins such as gelatin derivatives, graft polymers of gelatin and other polymers, albumin and casein; cellulose derivatives such as hydroxyethyl cellulose, carboxymethyl cellulose and cellulose sulfate; saccharide derivatives such as sodium alginate, dextran and starch derivatives; and many kinds of synthetic hydrophilic polymers such as homopolymers or copolymers of polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole. As gelatin, acid-treated gelatin and enzyme-treated gelatin, as well as lime-treated gelatin, may be used, and hydrolyzed products of gelatin and enzyme-decomposed products of gelatin can also be used. Of these, it is preferred to use dextran having an average molecular weight of 50,000 or less or polyacrylamide in combination with gelatin. Methods described in JP-A-63-68837 and JP-A-63-149641 are also effective in the present invention.

In the photographic materials produced by the present invention, the photographic emulsions and other light-insensitive hydrophilic colloids may contain inorganic or organic hardening agents. Examples of the hardening agents include chromium salts (.such as chromium alum and chromium acetate), aldehydes (such as formaldehyde, glyoxal and glutaraldehyde), N-methylol compounds (such as dimethylolurea and methyloldimethylhydantoin), dioxane derivatives (such as 2,3-dihydroxydioxane), active vinyl compounds (such as 1,3,5-triacryloylhexahydro-s-triazine, bis(vinylsulfonyl)methyl-ether and N,N'-methylenebis[β-(vinylsulfonyl)methyl-ether), active halogen compounds (such as 2,4-dichloro-6-hydroxy-s-triazine), mucohalogen acids (such as mucochloric acid and mucophenoxychloric acid), isooxazole compounds, dialdehyde starch and 2-chloro-6-hydroxytriazinylated gelatin. They can be used alone or in combination.

The hydrophilic colloidal layers in the photographic materials produced according to the present invention are preferably hardened to a swelling rate in water of 280% or less with these hardening agents. In the present invention, the swelling rate in water is measured by the lyophilization method. That is, the swelling rate of a hydrophilic colloidal layer of a photographic material is measured after an elapse of 7 days under conditions of 25° C. and 60% RH. The thickness of a dried layer (a) is determined under a scanning electron microscope. The thickness of a swelled film layer (b) is determined by observing the photographic material lyophilized with liquid nitrogen after immersion in distilled water at 21° C. for 3 minutes under a scanning electron microscope. The swelling rate is calculated according to the equation: $\{(b)-(a)\}/(a)\times 100$ (%). The swelling rate of the hydrophilic colloidal layer of the photographic material is preferably 100% to 230%, more preferably 120% to 200%.

In the present invention, plasticizers such as polymers and emulsified products can be added to the emulsion layers of the photographic materials to improve pressure characteristics. For example, British Patent 738,618 discloses the use of heterocyclic compounds, British Patent 738,637 discloses the use of alkyl phthalates, British Patent 738,639 discloses the use of alkyl esters, U.S. Pat. No. 2,960,404 discloses the use of polyhydric alcohols, U.S. Pat. No. 3,121,060 discloses the use of carboxyalkyl cellulose, JP-A-49-5017 discloses the use of paraffins and carboxylates, and JP-A-53-28086 discloses the use of alkyl acrylates. There is no particular limitation on the other constitution of the emulsion layers of the silver halide photographic materials according to the present invention, and various additives can be used if necessary. For example, there can be used binders, surfactants, dyes, coating aids, viscosity improvers, etc. described in *Research Disclosure,* 176, 22–28 (December, 1978).

A silver halide photographic material provided with photographic emulsion layers on both sides thereof has the problem crossover light is liable to deteriorate the image quality. This crossover light is visible light emitted from respective sensitizing screens disposed on both sides of the photographic material, and passing through a support (usually, a thick support having a thickness of about 170 μm to about 180 μm is used) of the photographic material to reach each light-sensitive layer on the opposite side, which causes deterioration of image quality (particularly, sharpness).

Less crossover light provides a sharper image. The crossover light can be reduced by various methods. A method is most preferred in which a dye decolorizable by development processing is fixated between a support and a light-sensitive layer. The use of microcrystalline dyes is very favorable for reducing the crossover light, because of their good fixation, their good decolorization and their possible inclusion in large amounts. This method does not induce desensitizing due to poor fixation, makes it possible to decolorize the dyes by 90-second treatment, and can reduce the crossover light to 15% or less.

More preferably, a dye layer for decreasing the crossover light is a layer in which a dye is disposed at as high a density as possible. It is preferred that the amount of gelatin applied as a binder is decreased to give a dye layer thickness of 0.5 μm or less. However, an extreme reduction in layer thickness is liable to result in poor adhesion. The most preferred thickness of the dye layer is 0.05 μm to 0.3 μm.

Silver chloride, silver chlorobromide, silver iodobromide or silver chloroiodobromide emulsions can be prepared by application of methods described in P. Glafkides, *Chimie et Physique Photographique* (Paul Montel, 1967), G. F. Duffin, *Photographic Emulsion Chemistry* (The Focal Press, 1966), V. L. Zelikman et al., *Making and Coating Photographic Emulsion* (The Focal Press, 1964), etc. Namely, any of the acid process, the neutral process and the ammonia process may be applied. In particular, the acid process and the neutral process are preferred in that fog is reduced in the present invention. Further, any of the so-called single jet process, the double jet process and a combination thereof may be used to obtain a silver halide emulsion by reacting a soluble silver salt with a soluble halogen salt. The process in which grains are formed in the presence of excess silver ions, the so-called reverse mixing process, can also be used. In order to obtain an emulsion of monodisperse grains favorable in the present invention, the double jet process is preferably used. As a type of double jet process, there is more preferably used a process for maintaining the silver ion concentration in a liquid phase constant, in which a silver halide is formed, namely the so-called controlled double jet process. By the use of this process, silver halide emulsions having a regular crystal form and a narrow grain size distribution can be prepared.

In order to form high silver chloride grains, there can be preferably used methods using bispyridinium compounds described in JP-A-2-32, JP-A-3-137632, JP-A-4-6546, JP-A-5-127279, JP-A-5-53231, etc. and methods described in JP-A-62-293536, JP-A-1-155332, JP-A-63-2043, JP-A-63-25643, U.S. Pat. Nos. 4,400,463 and 5,061,617.

In the course of grain formation or physical ripening of such silver halides, cadmium salts, zinc salts, lead salts, thallium salts, iridium salts or complex salts thereof, rhodium salts or complex salts thereof, or iron salts or complex salts thereof may be allowed to coexist with the silver halide emulsions.

In grain formation or after grain formation, solvents for silver halides (for example, ammonium, thiocyanates, and thioethers and thiones described in U.S. Pat. No. 3,271,157, JP-A-51-12360, JP-A-53-82408, JP-A-53-144319, JP-A-54-100717 and JP-A-54-155828, as known solvents) may be used, and by the use thereof in combination with the above-mentioned processes, silver halide emulsions having a regular crystal form and a narrow grain size distribution can be obtained.

In black-and-white photographic materials produced by the present invention, hydrophilic colloidal layers may contain water-soluble dyes as filter dyes or for irradiation prevention or for other various purposes. Such dyes include oxonol dyes, hemioxonol dyes, styryl dyes, merocyanine dyes, cyanine dyes and azo dyes. Of these, oxonol dyes, hemioxonol dyes and merocyanine dyes are useful.

The supports of the photographic materials according to the present invention is required to have a thickness of 150 μm to 250 μm. This is indispensable for the handling when observed on a light table for medical film. As a material for the support, a polyethylene terephthalate film is preferred, and particularly, it is preferably colored blue.

In order to improve the adhesion with hydrophilic colloidal layers, it is preferred that surfaces of the supports are subjected to corona discharge treatment, glow discharge treatment or ultraviolet irradiation treatment. An undercoat layer comprising a styrene-butadiene latex, vinylidene chloride latex or the like may be formed, and a gelatin layer may be further formed thereon.

Further, an undercoat layer using an organic solvent containing a polyethylene lubricant and gelatin may be provided.

Various additives described in the following corresponding portions can be used in the photographic materials of the present invention.

| Item | Corresponding Portion |
|---|---|
| 1. Chemical Sensitization | JP-A-2-68539, page 10, upper right column, line 13 to upper left column, line 16; JP-A-5-313282 |
| 2. Antifoggants and Stabilizers | JP-A-2-68539, page 10, lower left column, line 17 to page 11, upper left column, line 7; page 3, lower left column, line 2 to page 4, lower left column |
| 3. Tone Improvers | JP-A-62-276539, page 2, lower left column, line 7 to page 10, lower left column, line 20; JP-A-3-94249, page 6, lower left column, line 15 to page 11, upper right column, line 19 |
| 4. Surfactants and Antistatic Agents | JP-A-2-68539, page 11, upper left column, line 14 to page 12, upper left column, line 9 |
| 5. Matte Agents, Lubricants and Plasticizers | JP-A-2-68539, page 12, upper left column, line 10 to upper right column, line 10, page 14, lower left column, line 10 to lower right column, line 1 |
| 6. Hydrophilic Colloids | JP-A-2-68539, page 12, upper right column, line 11 to lower left column, line 16 |
| 7. Hardeners | JP-A-2-68539, page 12, lower left column, line 17 to page 13, upper right column, line 6 |
| 8. Polyhydroxybenzenes | JP-A-3-39948, page 11, upper left column to page 12, lower left column; EP-A-452772 |
| 9. Layer Constitution | JP-A-3-198041 |

Preferred embodiments of the present invention are as follows:

1. A method for storing a developing solution, wherein the developing solution used in claim 1 below is a single-liquid concentrated developing solution;

2. The method of claim 1 below, wherein the silver halide photographic material has a swelling rate of 150% or more;

3. The method of claim 1 below, wherein the silver halide grains comprise 10 to 100 mol% of silver chloride, 10 to 100 mol% of silver bromide and 0 to 5 mol% of silver iodide;

4. The method of claim 1 below, wherein the total processing time (dry to dry) is 20 seconds to 180 seconds;

5. The method of claim 1 below, wherein an automatic processor is used which houses a chemical mixer and has a mechanism of concurrently consuming the developing solution and a fixing solution contained in respective cartridges;

6. The method of claim 1 below, wherein the developing solution is substantially free from a boron compound;

7. A developing solution which is the developing solution used in the method of claim 1 below, wherein 50 mol% or more of all cations are potassium ions;

8. The method of claim 1 below, wherein a fixing solution contains 0 to 0.3 mol/liter of a meso-ionic compound;

9. A method for storing the developing solution used in the method of claim 1 below, wherein the developing solution is stored in a packaging material having an oxygen permeability of 50 ml/$m^2$.atm.day (at a temperature of 20° C. at a relative humidity of 65%) or less;

10. The method of claim 2 below, wherein an automatic processor for processing the silver halide photographic material has an opening ratio of 0.04 $cm^{-1}$ or less;

11. The method of claim 1 below, wherein the temperature of a heating means of a roller portion with which the photographic material comes into contact in a front step of a drying unit of an automatic processor is 70° C. or more;

12. The method of claim 1 below, wherein a single-liquid concentrated developing solution and a single-liquid concentrated fixing solution is each diluted with water in each tank to a working solution, which is supplied as a replenisher (a system of mixing dilution just before use);

13. The method of claim 1 below, wherein containers for a developing concentrated solution and a fixing concentrated solution are an integral packaging material;

14. The method of claim 1 below, wherein an automatic processor is used in which rinsing tanks and rinsing rollers (crossover rollers) are installed between a developing tank and a fixing tank, and between the fixing tank and a washing tank;

15. The method of claim 1 below, wherein an automatic processor is used which is provided with a stock tank for water supplied to a washing tank and a rinsing tank containing various scale inhibitors (microbiocides);

16. The method of claim 1 below, wherein an automatic processor is used in which an electromagnetic valve is mounted on a drain outlet of a washing tank;

17. The method of claim 1 below, wherein a washing tank of an automatic processor is a multi-chamber tank and has a multistage countercurrent system; and 18. The method of claim 1 below, wherein the developing solution contains 0.5 mol/liter or more of a carbonate.

The present invention will be further described in greater detail with reference to the following examples, which are, however, not to be construed as limiting the invention.

EXAMPLE 1

Preparation of Photographic Material (Preparation of High-Sensitivity Tabular Emulsion T-1)

To 1 liter of water placed in a vessel, 6.9 g of potassium bromide and 6.3 g of low-molecular weight gelatin having an average molecular weight of 15,000 were added, and maintained at 40° C. Then, 37 cc of an aqueous solution of silver nitrate (4 g of silver nitrate) and 37 cc of an aqueous solution containing 5.9 g of potassium bromide were added thereto with stirring by the double jet process for 37 seconds.

After addition of 18.6 g of gelatin, the temperature was elevated to 53° C., and 89 cc of an aqueous solution of silver nitrate (9.7 g of silver nitrate) was added for 22 minutes. At this time, 5.1 cc of 25% aqueous ammonia was added thereto, and the resulting solution was subjected to physical ripening at that temperature for 10 minutes, followed by addition of 4.7 cc of a 100% acetic acid solution. Subsequently, an aqueous solution containing 151.5 g of silver nitrate and an aqueous solution of potassium bromide were added with keeping the pAg at 8.5 and accelerating the flow rate (initial flow rate/final flow rate=1/5.7) by the double jet process for 35 minutes. Then, 15 cc of a 2N potassium thiocyanate solution was added thereto. After physical ripening at that temperature for 5 minutes, the temperature was lowered to 35° C. Thus, silver halide grains were obtained in which tabular silver bromide grains having an aspect ratio of 5.0 or more occupy 50% or more of all projected areas.

Thereafter, soluble salts were removed by coagulating sedimentation. The temperature was elevated to 40° C. again, and 35 g of gelatin, 85 mg of proxel and 0.4 g of polysodium styrenesulfonate as a viscosity improver were added, followed by adjustment to pH 6.40 and pAg 8.30 with sodium hydroxide and a silver nitrate solution.

The resulting emulsion was subjected to chemical sensitization with stirring and keeping the temperature at 56° C. First, $C_2H_5SO_2SNa$ was added in an amount of $1\times10^{-5}$ mol/mol of Ag, and then fine AgI grains having a grain size of 0.03 km were added in an amount of 0.002 mol/mol of Ag. Subsequently, 4-hydroxy-6-methyl-1,3,3a,7-tetraazaindene was added in an amount of 160 mg/mol of Ag, and sensitizing dyes I-1 and I-2 were each added in an amount of $4\times10^{-4}$ mol/mol of Ag.

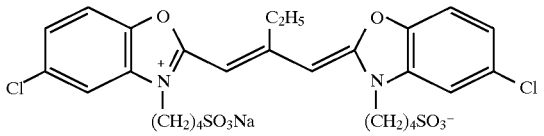

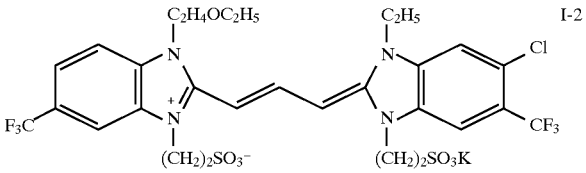

Further, 1.3 mg/mol of Ag of sodium thiosulfate, 1.3 mg/mol of Ag of selenium compound C, 4.5 mg/mol of Ag of chloroauric acid and 60 mg/mol of Ag of potassium thiocyanate were added thereto, and the resulting emulsion was cooled to 35° C. Thus, tabular grain emulsion Ti was prepared.

Selenium Compound C

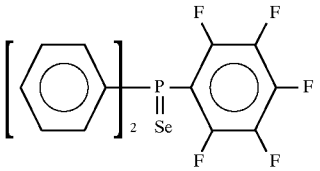

(Preparation of Dye Dispersion A for Undercoat Layer)

The following dye 1 was treated in a ball mill by the method described in JP-A-63-197943.

Dye 1

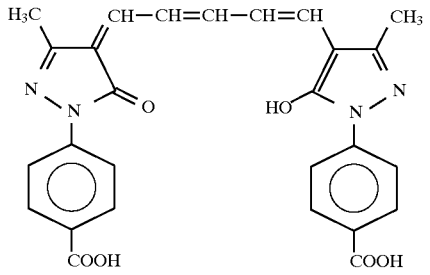

In a 2-liter ball mill, 434 ml of water and 791 ml of a 6.7% aqueous solution of surfactant Triton X-20 (TX-200) were placed, and 20 g of the dye was added to the resulting solution. Then, 400 ml of zirconium oxide ($ZrO_2$) beads (2 mm in diameter) was added thereto, and the contents were pulverized for 4 days. Thereafter, 160 g of 12.5% gelatin was added thereto. After deaeration, the $ZrO_2$ beads were removed by filtration. The observation of the resulting dye dispersion showed that the grain size of the pulverized dye was in the wide range of 0.05 to 1.15 lim and the mean grain size was 0.37 $\mu$m.

Further, dye grains having a size of 0.9 $\mu$m or more were removed by centrifugal separation.

Thus, dye dispersion A was obtained.

(Preparation of Support)

A 175 $\mu$m-thick blue-colored biaxial oriented polyethylene terephthalate film was subjected to corona discharge, and one surface thereof was coated with a first undercoating solution having the following composition with a wire bar coater so as to give an amount coated of 4.9 cc/$m^2$, followed by drying at 185° C. for 1 minute.

Then, a first undercoat layer was similarly formed on the opposite side thereof.

Butadiene-Styrene Copolymer Latex Solution 158 cc (solid content: 40%, butadiene/styrene ratio by weight=31/69)

4% Solution of 2,4-Dichloro-6-hydroxy-s-triazine Sodium Salt 41 cc

Distilled Water 300 cc

The above-mentioned first undercoat layers on both surfaces were coated with second undercoat layers having the following composition at 165° C. by the wire bar coater system, surface by surface, so as to give the following amounts coated, and dried.

Gelatin 160 mg/$m^2$

Dyestuff Dispersion A (as the dyestuff solid) 8 mg/$m^2$ $C_{12}H_{25}O(CH_2CH_2O)_{10}H$ 1.8 mg/$m^2$ Proxel 0.27 mg/$M^2$ Matte Agent (polymethyl methacrylate 2.5 mg/$m^2$ having a mean grain size of 2.5 $\mu$m)

Thus, a support having crossover cut layers was prepared.

(Preparation of Coating Solution for Emulsion Layers)

A coating solution for emulsion layers was prepared so that respective ingredients added to emulsion T-1 gave the following amounts coated per one side of the support.

2,6-Bis(hydroxyamino)-4-diethylamino-1,3,5-triazine 1.7 mg/$m^2$

Dextran 0.45 g/$m^2$

Polypotassium styrenesulfonate (average molecular weight: 600,000) (including one added to the emulsion) 33 mg/$m^2$ Gelatin 1.1 g/m$^2$ (including one added to the emulsion)

Hardener 1,2-Bis(vinylsulfonylacetamido)ethane 41 mg/m$^2$

Compound 1 0.11 g/m$^2$

Compound 2 0.36 mg/m$^2$

Dye 2 0.28 g/m$^2$ (added as dye emulsion B described later)

Compound 1

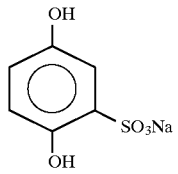

Compound 2

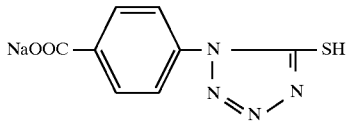

Dye 2

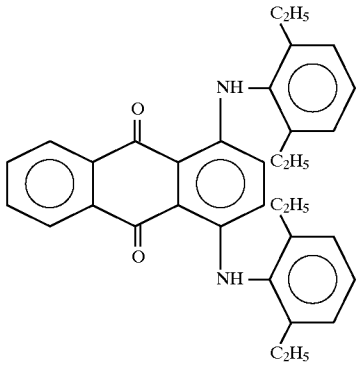

(Preparation of Dye Emulsion B)

Sixty grams of the above-mentioned dye 2 was dissolved in 62.8 g of high boiling organic solvent 1 shown below, 62.8 g of high boiling organic solvent 2 shown below and 333 g of ethyl acetate at 60° C. Then, 65 cc of a 5% aqueous solution of sodium dodecylsulfonate, 94 g of gelatin and 581 cc of water were added thereto, and the mixture was emulsified at 60° C. for 30 minutes using a dissolver. Thereafter, 2 g of compound P shown below and 6 liters of water were added, and the mixture was cooled to 40 ° C. The mixture was concentrated using an Ultrafiltration Labomodule ACP1050 manufactured by Asahi Chemical Industry until the whole amount reached 2 kg, and 1 g of the above-mentioned compound P was added to make dye emulsion B.

High Boiling Organic Solvent 1

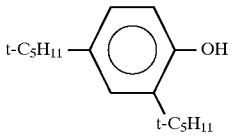

-continued

High Boiling Organic Solvent 2

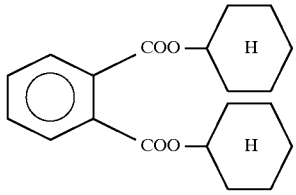

Compound P

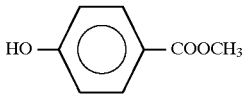

(Preparation of Coating Solution for Surface Protecting Layer)

A coating solution for a surface protecting layer was prepared so that respective ingredients of the surface protective layer gave the following amounts coated per one side of the support.

Gelatin 1.11 g/m$^2$

Proxel 1.4 mg/m$^2$

Polysodium Acrylate (average molecular weight: 410,000) 34 mg/m$^2$ $C_{18}H_{33}O(CH_2CH_2O)_{10}H$ 35 mg/m$^2$ $C_8F_{17}SO_3K$ 5.4 mg/m$^2$ Additive 1 22.5 mg/m$^2$ Additive 2 0.5 mg/]m$^2$ Matte Agent 1 (average grain size: 3.7 $\mu$m) 72.5 mg/m$^2$ Compound 3 1.3 mg/m$^2$ Compound 4 0.5 mg/m$^2$ Additive 1

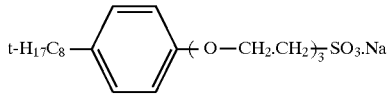

Additive 2

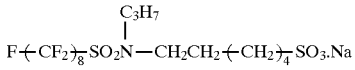

Matte Agent 1

(X/Y/Z = 76.3/17.5/6.2)

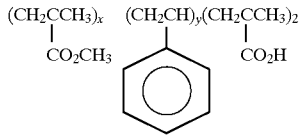

Compound 3

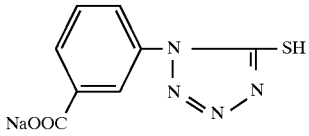

-continued

Compound 4

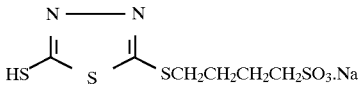

(Preparation of Photographic Material S-1)

The emulsion and the coating solution for the surface protective layer previously prepared were successively applied to both sides of the above-mentioned support under the same conditions by the simultaneous extrusion process to prepare photographic material S-1.

The coating flow rate was established so as to give an amount of silver coated of 1.15 g/m$^2$per one side of the support (2.3 g/m$^2$ on both sides).

For the resulting photographic material, the swelling rate was measured according to the method and the definition described in JP-A-58-11193. As a result, the swelling rate was 170%. The above-mentioned tabular emulsion T-1 is an emulsion in which silver halide grains having an aspect ratio of 5.0 or more occupy 50% or more of all projected areas. However, emulsions in which silver halide grains having aspect ratios of 2.5, 3.5, 5.0, 6.0 and 8.0 or more, respectively, occupy 50% or more of all projected areas were prepared by controlling the amount of aqueous ammonia, the temperature, the amount of acetic acid and the pAg, as well known in the art. The subsequent procedures were conducted in the same manner as with photographic material S-1. The films thus prepared using the emulsions in which silver halide grains having aspect ratios of 2.5, 3.5, 5.0, 6.0 and. 8.0 or more, respectively, occupy 50% or more of all projected areas were named films A, B, C, D and E, respectively.

(Preparation of Developing Solutions)

Replenishers for developing solutions as shown in Table 1 were formulated. As a fixing solution, CE-F1 manufactured by Fuji Photo Film Co. Ltd. was used.

TABLE 1

| Replenisher for Developing Solution | 1 Comparison | 2 Comparison | 3 Comparison | 4 Comparison | 5 Comparison | 6 Comparison | 7 Comparison |
|---|---|---|---|---|---|---|---|
| Developing Agent (A-1) of Formula (A) | — | — | — | — | — | — | 30.0 g |
| Hydroquinone | 18.8 g | 18.8 g | 18.8 g | 18.8 g | 18.8 g | 18.8 g | — |
| Diethylenetriaminepentaacetic Acid | 2.0 g | 2.0 g | 2.0 g | 2.0 g | 2.0 g | 2.0 g | 2.0 g |
| Potassium Bromide | 2.0 g | 2.0 g | 2.0 g | 2.0 g | 2.0 g | 2.0 g | 2.0 g |
| 5-Methylbenzotriazole | 0.06 g | 0.06 g | 0.06 g | 0.06 g | 0.06g | 0.06 g | 0.06 g |
| 3,3'-Dithiobishydrocinamic Acid | 0.72 g | 0.72 g | 0.72 g | 0.72 g | 0.72 g | 0.72 g | |
| Sodium Suifite | 50.0 g | 50.0 g | 50.0 g | 50.0 g | 50.0 g | 50.0 g | 50.0 g |
| Potassium Hydrogencarbonate | 40.0 g | 40.0 g | 40.0 g | 40.0 g | 40.0 g | 40.0 g | 40.0 g |
| 4-Methyl-4-hydroxymethyl-1-phenyl-3-pyrazolidone | 6.0 g | 6.0 g | 6.0 g | 6.0 g | 6.0 g | 6.0 g | 6.0 g |
| Diethylene Glycol | 25.0 g | 25.0 g | 25.0 g | 25.0 g | 25.0 g | 25.0 g | 25.0 g |
| Compound of Formula (B) | Not added | Not added | B-3 1 mmol | B-8 1 mmol | B-9 1 mmol | B-15 1 mmol | Not added |
| 1-Phenyl-5-mercaptotetrazole | — | 1 mmol | — | — | — | — | — |

Water was added to adjust the volume to 1 liter.
The pH was adjusted to 10.6 with NaOH.

| Replenisher for Developing Solution | 8 Comparison | 9 Invention | 10 Invention | 11 Invention | 12 Invention |
|---|---|---|---|---|---|
| Developing Agent (A-1) of Formula (A) | 30.0 g | 30.0 g | 30.0 g | 30.0 g | 30.0 g |
| Hydroquinone | — | — | — | — | — |
| Diethylenetriaminepentaacetic Acid | 2.0 g | 2.0 g | 2.0 g | 2.0 g | 2.0 g |
| Potassium Bromide | 2.0 g | 2.0 g | 2.0 g | 2.0 g | 2.0 g |
| 5-Methylbenzotriazole | 0.06 g | 0.06 g | 0.06 g | 0.06 g | 0.06 g |
| 3,3'-Dithiobishydrocinamic Acid | 0.72 g | 0.72 g | 0.72 g | 0.72 g | 0.72 g |
| Sodium Sulfite | 50.0 g | 50.0 g | 50.0 g | 50.0 g | 50.0 g |
| Potassium Hydrogencarbonate | 40.0 g | 40.0 g | 40.0 g | 40.0 g | 40.0 g |
| 4-Methyl-4-hydroxymethyl-1-phenyl-3-pyrazolidone | 6.0 g | 6.0 g | 6.0 g | 6.0 g | 6.0 g |
| Diethylene Glycol | 25.0 g | 25.0 g | 25.0 g | 25.0 g | 25.0 g |
| Compound of Formula (B) | Not added | B-3 1 mmol | B-8 1 mmol | B-9 1 mmol | B-15 1 mmol |
| 1-Phenyl-5-mercaptotetrazole | 1 mmol | — | — | — | — |

Water was added to adjust the volume to 1 liter.
The pH was adjusted to 10.6 with NaOH.

Development processing was performed with an FPM-1300 automatic processor manufactured by Fuji Photo Film Co. Ltd. in which the opening ratio of a developing tank was converted to 0.02 $cm^{-1}$ and driving gears were converted so as to give a total processing time of 120 seconds. Potassium bromide was added to the respective developing replenishers 1 to 12 shown in Table 1 in an amount of 7.0 g per liter of replenisher, and acetic acid was added thereto to adjust the solutions to pH 10.0. The resulting solutions were used as developing mother liquors 1 to 12, respectively. The photographic materials were processed using these developing mother liquors at 35° C.

Results obtained are shown in Table 2, wherein the sensitivity is a value represented by the reciprocal of an exposure required for obtaining a blacking density of 1.0 when film A is developed using developing mother liquor 1. The color tones of silver images are evaluated according to the following standard:

1: Neutral black

2: Slightly bluish black

3: Bluish black

4: Slightly yellowish black

5: Yellowish black 1 and 2 are preferred, and 4 and 5 are practically unfavorable.

EXAMPLE 2

Replenishing developing replenishers 1 to 12 shown in Table 1 in Example 1 at a replenishment rate of 150 ml per $m^2$ of silver halide photographic material, development processing was conducted until the equilibrium state was reached. As a result, similarly to Example 1, film A having silver halide emulsion layers comprising silver halide grains having an aspect ratio of 2.5 provided good color tones of silver images similarly either with developing mother liquors 1 to 6 each containing hydroquinone as the developing agent, or with developing mother liquors 7 to 12 each containing ascorbic as the developing agent.

On the other hand, films B, C, D and E having silver halide emulsion layers comprising silver halide grains having an aspect ratio of 3.0 or more all provided practically available color tones of silver images with developing mother liquor 1 containing hydroquinone as the developing agent. However, all of them gave unpractical yellowish color tones of silver images with developing mother liquor 7 containing ascorbic acid as the developing agent. The mother liquor 8 containing 1-phenyl-5-mercaptotetrazole improved the color tones of silver images, but unfavorably caused a significant reduction in sensitivity. Developing mother liquors 9, 10, 11 and 12 according to the present invention were slightly reduced in sensitivity compared to developing mother liquor 7, and improved the color tones of silver images.

TABLE 2

| Replenisher for Developing Solution | | 1 | 2 | 3 | 4 | 5 | 6 | 7 | 8 | 9 | 10 | 11 | 12 |
|---|---|---|---|---|---|---|---|---|---|---|---|---|---|
| Sensitivity | Aspect Ratio | | | | | | | | | | | | |
| Film A | (2.5) | 100 | 50 | 95 | 95 | 95 | 95 | 100 | 50 | 95 | 95 | 95 | 95 |
| Film B | (3.5) | 140 | 70 | 135 | 135 | 135 | 135 | 140 | 70 | 135 | 135 | 135 | 135 |
| Film C | (5.0) | 160 | 80 | 155 | 155 | 155 | 155 | 160 | 80 | 155 | 155 | 155 | 155 |
| Film D | (6.0) | 180 | 90 | 170 | 170 | 170 | 170 | 180 | 90 | 170 | 170 | 170 | 170 |
| Film E | (8.0) | 200 | 100 | 190 | 190 | 190 | 190 | 200 | 100 | 190 | 190 | 190 | 190 |
| Silver Tone | | | | | | | | | | | | | |
| Film A | | 2 | 1 | 1 | 1 | 1 | 1 | 2 | 1 | 1 | 1 | 1 | 1 |
| Film B | | 2 | 2 | 2 | 2 | 2 | 2 | 4 | 2 | 2 | 2 | 2 | 2 |
| Film C | | 2 | 2 | 2 | 2 | 2 | 2 | 4 | 2 | 2 | 2 | 2 | 2 |
| Film D | | 3 | 2 | 2 | 2 | 2 | 2 | 5 | 2 | 2 | 2 | 2 | 2 |
| Film E | | 3 | 2 | 2 | 2 | 2 | 2 | 5 | 2 | 2 | 2 | 2 | 2 |

As apparent from the results shown in Table 2, film A having silver halide emulsion layers comprising silver halide grains having an aspect ratio of 2.5 provides good color tones of silver images similarly either with developing mother liquors 1 to 6 each containing hydroquinone as a developing agent, or with developing mother liquors 7 to 12 each containing ascorbic as a developing agent.

On the other hand, films B, C, D and E having silver halide emulsion layers comprising silver halide grains having an aspect ratio of 3.0 or more all provide practically available color tones of silver images with developing mother liquor 1 containing hydroquinone as the developing agent. However, all of them give unpractical yellowish color tones of silver images with developing mother liquor 7 containing ascorbic acid as the developing agent. The mother liquor 8 containing 1-phenyl-5-mercaptotetrazole to improve the color tones of silver images of the ascorbic acid developing agent. improves the color tones of silver images, but unfavorably causes a significant reduction in sensitivity. Developing mother liquors 9, 10, 11 and 12 according to the present invention are slightly reduced in sensitivity compared to developing mother liquor 7, and improve the color tones of silver images.

What is claimed is:

1. A method for developing a silver halide photographic material, comprising processing a silver halide photographic material having at least one silver halide emulsion layer containing silver halide grains, wherein at least 50% of the sum of the projected area of the silver halide grains are tabular silver halide grains having an aspect ratio of 3.0 or more, with a substantially hydroquinone-free developing solution comprising (i) a compound represented by formula (A) as a developing agent,

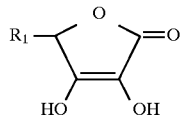

(A)

wherein $R_1$ represents a hydrogen atom, an alkyl group, an aryl group or a heterocyclic group; and (ii) a compound represented by formula (C):

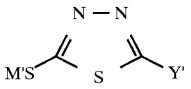

(C)

wherein Y' represents an alkylthio group, and M' represents a hydrogen atom, an alkali metal ion, a quaternary ammonium ion or a quaternary phosphonium ion;

wherein said developing solution contains the compound represented by the formula (A) in an amount of 5 to 80 g/l and contains the compound represented by the formula (C) in an amount of 0.1 to 5.0 mmol/l.

2. The method of claim 1, wherein the replenishment rate of the substantially hydroquinone-free developing solution is 200 ml or less per $m^2$ of the silver halide photographic material.

3. The method of claim 1, wherein said developing solution contains an auxiliary developing agent showing superadditivity in an amount of $10^{-4}$ to $10^{-1}$ mol/l.

4. The method of claim 1, wherein said developing solution has a pH of 9.3 or more.

5. The method of claim 1, wherein the silver halide photographic material has a swelling rate of 280% or less.

* * * * *